United States Patent [19]

Gogniat

[11] Patent Number: 4,464,063

[45] Date of Patent: Aug. 7, 1984

[54] WATCH CASE COMPRISING RESILIENT U-SHAPE CLAMPING MEMBERS CONNECTING CRYSTAL AND CASE

[75] Inventor: Paul Gogniat, Bienne, Switzerland

[73] Assignee: Montres Rado S.A., Longeau, Switzerland

[21] Appl. No.: 445,730

[22] Filed: Nov. 30, 1982

[30] Foreign Application Priority Data

Dec. 2, 1981 [CH] Switzerland ..... 7706/81

[51] Int. Cl.[3] ..... G04B 37/00

[52] U.S. Cl. ..... 368/276; 368/281; 368/294

[58] Field of Search ..... 368/276, 281, 291, 292, 368/294, 295, 296, 88, 204, 286, 300; 73/431

[56] References Cited

U.S. PATENT DOCUMENTS

| | | | |
|---|---|---|---|
| 3,952,249 | 4/1976 | Colman | 73/431 X |
| 4,222,228 | 9/1980 | Masui | 368/276 X |
| 4,257,118 | 3/1981 | Futaba et al. | 368/276 |
| 4,322,835 | 3/1982 | Ernst et al. | 368/276 X |
| 4,379,644 | 4/1983 | Capolupo et al. | 368/276 X |
| 4,390,288 | 6/1983 | Arnoux | 368/276 |

*Primary Examiner*—J. V. Truhe
*Assistant Examiner*—Terry Flower
*Attorney, Agent, or Firm*—Peter L. Berger

[57] ABSTRACT

The watch case contains a crystal (1) and a casing (3), on an upper peripheral surface (2) of which the crystal (1) is detachably mounted by means of connecting members or straps (10). These connecting members may consist of a U-shaped clamps (10) having arms (11, 12) to which the edges of the crystal (1) and the casing (3) are tightened and which are capable of being set in place by being laterally engaged on the edges of the case.

6 Claims, 5 Drawing Figures

WATCH CASE COMPRISING RESILIENT U-SHAPE CLAMPING MEMBERS CONNECTING CRYSTAL AND CASE

This invention concerns, in particular, watch cases containing a crystal and a casing, the crystal being detachably mounted on an upper peripheral surface of the casing by means of connecting members.

In the known watch cases and, notably, when the crystal extends over almost its whole circumference up to the side edges of the casing connecting members such as screws, pins, dovetail slides and claws mounted on the edges of the body are used.

Most of those solutions entail a particular machining of the crystal, such as drilling or the formation of beveled edges. Such machining is difficult and expensive, notably, for sapphire crystals included in quality watches. Furthermore, in order to assure the anchoring of the connecting members on the casing, it is usually necessary to provide for threads or other means which can be applied only to cases of a certain thickness. Designs are also known in which claws gripping the crystal form an integral part of the casing, but the fabrication of such a casing is very complicated.

Another disadvantage of the designs of the prior art, especially those that incorporate slides or claws in which the crystal is laterally engaged, is the risk of damage, wear or displacement of the seal at the time the crystal is set in place. Those same designs also result in thickening the general line of the watch.

That is why this invention proposes a new design that avoids the problems described above, notably, by using small connecting members which, surprisingly, are not integral with either the crystal or the casing, but are simply engaged on the edges of the case. These connecting members do not necessitate any particular machining of the crystal and the latter can, furthermore, extend over its entire circumference to the side edges of the casing which could previously be done detachably only by means of screws or pins.

The invention will be clearly understood by reading the following specification, given with reference to the attached drawings, among which:

Figure 1:
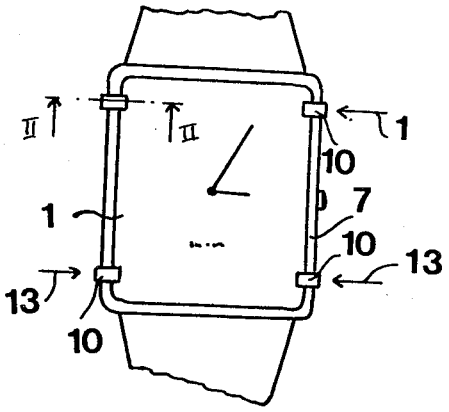
FIG. 1 is a top view of a watch case according to a first embodiment of the invention.
Figure 2:
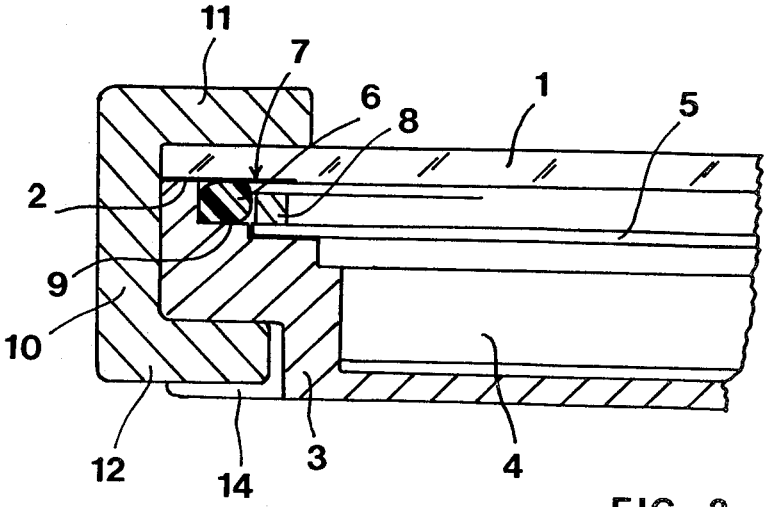
FIG. 2 is a view in partial section along line II—II of the watch case of FIG. 1.

The watch case of FIGS. 1 and 2 contains, notably, a crystal 1 mounted detachably on the upper surface 2 of a square casing 3 in which a movement 4 equipped with a dial 5 is mounted in standarrd fashion. A gasket 6 hidden by a metallized peripheral zone 7 on the bottom surface of the crystal and a riser 8 placed on the dial 5 is housed in a channel 9 of the casing 3. According to the invention, the crystal 1 and the casing 3 are kept assembled by means of connecting members or straps consisting of U-shaped clamps 10. Each clamp 10 contains opposite arms 11, 12, between which the edges of the crystal 1 and of the casing 3 are tightened. The clamps 10 are not integral with either the crystal 1 or the casing 3, but their retention is improved by the friction resulting from the separation stress exerted on the crystal and the casing by the gasket 6. They are set in place by a lateral engagement in the direction of the arrows 13 of FIG. 1 on the edges of the watch case. As can be seen on FIG. 2, the casing 3 has a recess 14 at its bottom into which the arms 12 of the clamps 10 are inserted.

Figure 3:
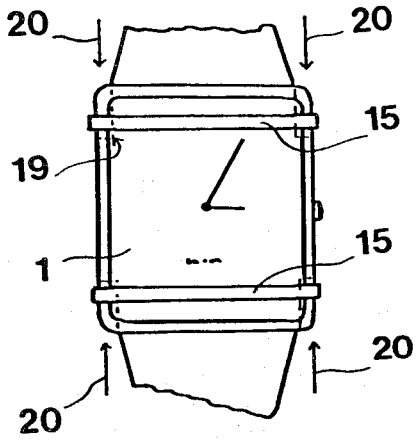
FIG. 3 is a top view of a watch case according to a second embodiment of the invention.
Figure 4:
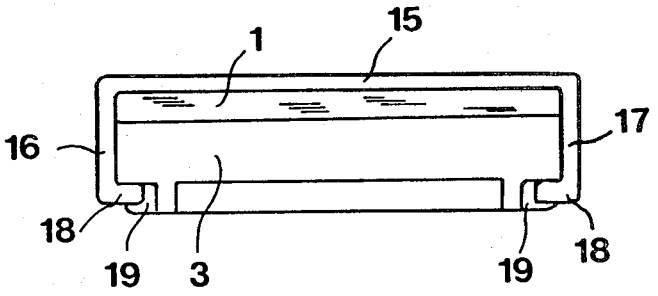
FIG. 4 is a view in elevation of the case of FIG. 3.

FIGS. 3 and 4 present another embodiment of the invention. The connecting members consist of two bars 15, which extend crosswise over the upper face of the crystal 1. At each end of the bars 15 there is formed a clamp 16, 17, terminating in arms 18 which are inserted in recesses 19 in the bottom of casing 3 when the bars are laterally slid on to the case in the direction of arrows 20.

Figure 5:
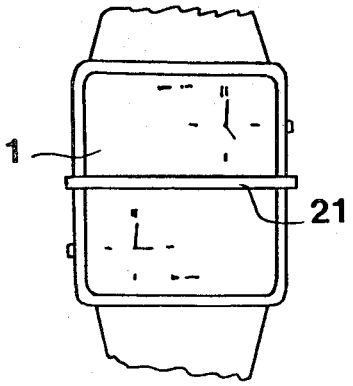
FIG. 5 is a top view of a watch case according to a third embodiment of the invention.

FIG. 5 represents a watch case similar to those of FIGS. 3 and 4 in which only one bar 21 is used for holding the crystal 1 on the casing.

Of course, other configurations for the tightening bars of FIGS. 3 to 5 are readily available. Likewise, although the invention is particularly well adapted to the mounting of a crystal extending over its entire circumference to the side edges of the casing, as indicated on the figures, this arrangement is necessary only in the vicinity of the clamps. It is also clear that the invention can just as well be applied to the assembly of elements of a watch case other than the crystal and the casing, notably, to the simultaneous fastening of a crystal and of a back on a casing.

Although it has been described in relation to particular embodiments, this invention is not all limited thereto, but, rather, lends itself to numerous modifications and variations which will be apparent to those skilled in the art.

What is claimed is:

1. A watch case comprising a crystal and a casing having an upper peripheral surface, said casing having a lower recessed peripheral surface, said upper peripheral surface terminating inwardly in a recessed seating surface, a resilient sealing member located in said seated surface having a height exceeding the depth of said recessed seating surface, said crystal being placed on said upper peripheral surface compressing said resilient sealing member, and connecting members comprising U-shaped clamps clamping said crystal and casing together and compressing said resilient sealing member, said U-shaped clamps being resilient and having one leg each bear against said lower recessed peripheral surface and the other leg each bear against the top of said crystal.

2. A watch case according to claim 1, wherein said crystal extends over its entire circumference to the side edges of the casing.

3. A watch case according to claims 1 or 2, wherein said resilient sealing member comprises an elastic gasket inserted between the crystal and the casing providing a stress force ensuring retention of the clamps.

4. A watch case according to claims 1 or 2, wherein the connecting members comprise said U-shaped clamps connected by a bar to form an internal connecting member.

5. A watch case according to claim 1, wherein said connecting members comprise pairs of separate clamps connected at opposite sides of said case.

6. A watch case according to claim 4, wherein said connecting members comprise a pair of said integral connecting members.

* * * * *